US009125545B2

(12) United States Patent
Hong

(10) Patent No.: US 9,125,545 B2
(45) Date of Patent: Sep. 8, 2015

(54) ROTARY DINNERWARE WASHING APPARATUS

(76) Inventor: Shane Y. Hong, Taichung (TW)

( * ) Notice: Subject to any disclaimer, the term of this patent is extended or adjusted under 35 U.S.C. 154(b) by 885 days.

(21) Appl. No.: 13/165,198

(22) Filed: Jun. 21, 2011

(65) Prior Publication Data

US 2012/0312338 A1 Dec. 13, 2012

(30) Foreign Application Priority Data

Jun. 9, 2011 (TW) ..... 100120197 A

(51) Int. Cl.
*A47L 15/30* (2006.01)

(52) U.S. Cl.
CPC ..... *A47L 15/30* (2013.01)

(58) Field of Classification Search
CPC ... A47L 15/30; A47L 15/243; A47L 15/0073; A47L 15/245; A47L 15/248
USPC ..... 134/124, 153, 157
See application file for complete search history.

(56) References Cited

U.S. PATENT DOCUMENTS 2,643,659 A * 6/1953 Auten ..... 134/80
3,094,997 A * 6/1963 Nolte et al. ..... 134/46
3,122,148 A * 2/1964 Alabaster ..... 134/56 D
4,832,064 A 5/1989 Nezworski et al.
2008/0314421 A1* 12/2008 Bauch et al. ..... 134/92

FOREIGN PATENT DOCUMENTS

CN 2036812 U 5/1989
CN 2049918 U 12/1989
CN 2137931 Y 7/1993
TW 422082 U 2/2001

* cited by examiner

*Primary Examiner* — David Cormier
*Assistant Examiner* — Irina Graf
(74) *Attorney, Agent, or Firm* — Muncy, Geissler, Olds & Lowe, P.C.

(57) ABSTRACT

A rotary dinnerware washing apparatus includes a housing defining therein a washing chamber, a washing mechanism mounted in the housing for spaying hot water over the washing chamber, and a rotating rack rotatably mounted in the washing chamber, a power drive arranged below the washing chamber for rotating the rotating rack in the washing chamber. The rotating rack has partitions radially suspending in the washing chamber and respectively kept in contact with the peripheral wall of the washing chamber and dividing the washing chamber into multiple separately enclosed zones, for example, two cleaning zones, two buffer zones at two opposite lateral sides of the cleaning zones and one dinnerware access zone between the buffer zones.

8 Claims, 9 Drawing Sheets

ROTARY DINNERWARE WASHING APPARATUS

BACKGROUND OF THE INVENTION

1. Field of the Invention

The present invention relates to washing apparatus and more particularly, to a rotary dinnerware washing apparatus, which divides the washing chamber into multiple separately enclosed zones for cleaning sorted dishes, cups, chopsticks, knives, spoons and many other dinnerware.

2. Description of the Related Art

Many dinnerware washing machines for industrial or home application are known and widely used by people.

During the operation of a dinnerware washing machine, a basket is used to carry the dinnerware to be washed and then put in the washing chamber in the dinnerware washing machine. After cleaning and drying, the cleaned pieces of dinnerware are taken out of the basket and arranged in a dish rack for service. Further, an automatic dinnerware washing system uses a conveyer to continuously carry dinnerware for cleaning. An automatic dinnerware washing system of this design is designed for use in a restaurant or any other place where a large number of dinnerware items is used.

In a conventional dinnerware washing machine or system, all dinnerware items receive a series of cleaning steps in one same operation space. During washing, cleaning fluid may splash over the surroundings or leak out of the machine to wet the surroundings, causing contamination.

To eliminate the aforesaid problem, U.S. Pat. No. 4,832,064 discloses a washing machine entitled "Glass washer with rotary carrier". According to this design, the machine has a glass carrier rotatable on an upright axis, half of the carrier is always in an access zone where glasses can be loaded onto the carrier and removed from it, the other half in a cleansing zone where detergent solution is discharged from a first set of spray nozzles and germicidal rinsing solution is discharged from a second set of nozzles. This design of glass washer uses a detergent solution with a large amount of water to clean glasses. In consequence, the cleaning cost is high. Further, this cleaning manner is not environmentally friendly. Further, blind means is set between the machine body and the rotary table to block the gap. However, cleaning solution may splash during a cleaning operation, wetting the surrounds.

SUMMARY OF THE INVENTION

The present invention has been accomplished under the circumstances in view. It is the main object of the present invention to provide a rotary dinnerware washing apparatus, which divides the internal washing chamber of the housing thereof into separately enclosed cleaning zones, buffer zones and dinnerware access zone, and utilizes hot water to sterilize cleaned dinnerware, eliminating the use of detergent, avoiding leakage of washing water or steam and maintaining the surroundings in a dry condition.

It is another object of the present invention to provide a rotary dinnerware washing apparatus, which provides a clutch design, avoiding component sticking and damage, and assuring a high level of operational safety.

It is still another object of the present invention to provide a rotary dinnerware washing apparatus, which facilitates recycling of food debris and waste water, saving energy consumption and providing an environmentally friendly atmosphere.

To achieve these and other objects of the present invention, a rotary dinnerware washing apparatus comprises a housing defining therein a washing chamber, a washing mechanism mounted in the housing for spaying cold and hot water over the washing chamber, and a rotating rack rotatably mounted in the washing chamber, a power drive arranged below the washing chamber for rotating the rotating rack in the washing chamber. The rotating rack has partitions radially suspending in the washing chamber and respectively kept in contact with the peripheral wall of the washing chamber and dividing the washing chamber into multiple separately enclosed zones, for example, two cleaning zones, two buffer zones at two opposite lateral sides of the cleaning zones and one dinnerware access zone between the buffer zones.

Further, a clutch is set between the power drive and the rotating rack. When the rotating rack is stopped from rotation by an external object, the clutch will be forced to disconnect the rotating rack from the power drive, avoiding a finger jam or power drive burnout due to an overload.

Further, a recycled water tank is mounted inside the housing for collecting food debris and waste water after dinnerware cleaning. Further, wire gauze filters of different meshes are used to remove food debris from waste water.

DETAILED DESCRIPTION OF THE INVENTION

Figure 1:
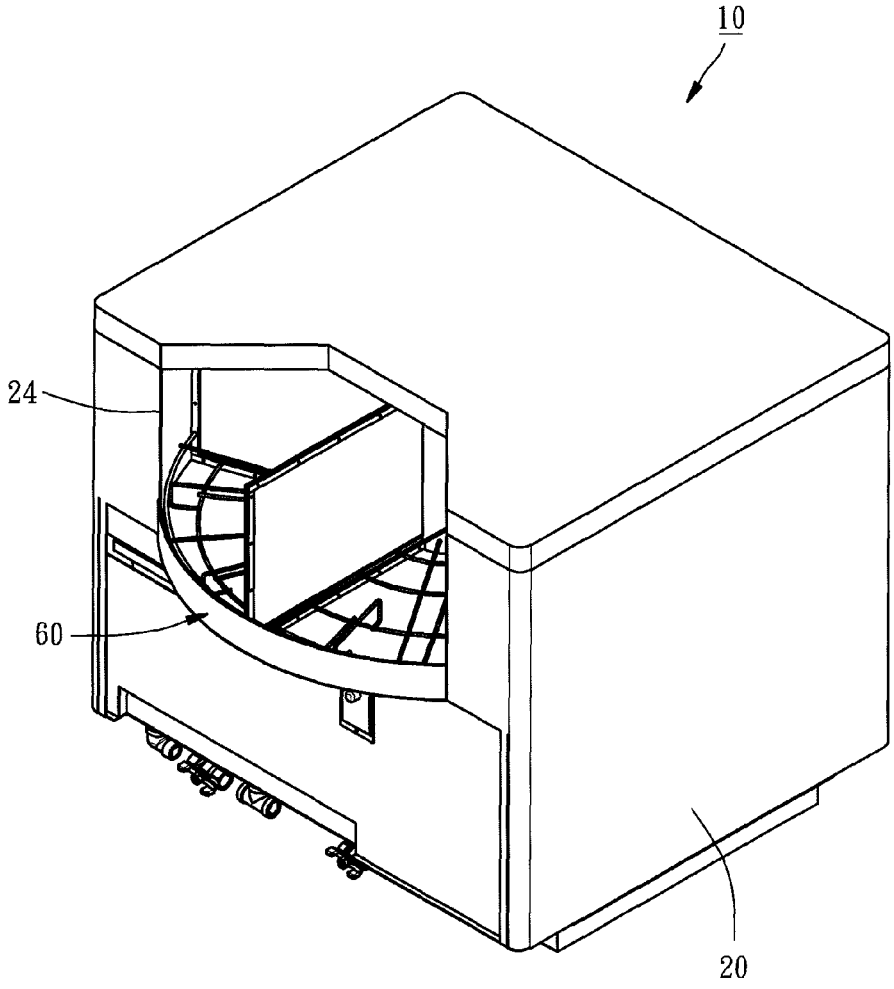
FIG. 1 is an elevational view of a rotary dinnerware washing apparatus in accordance with the present invention.
Figure 2:
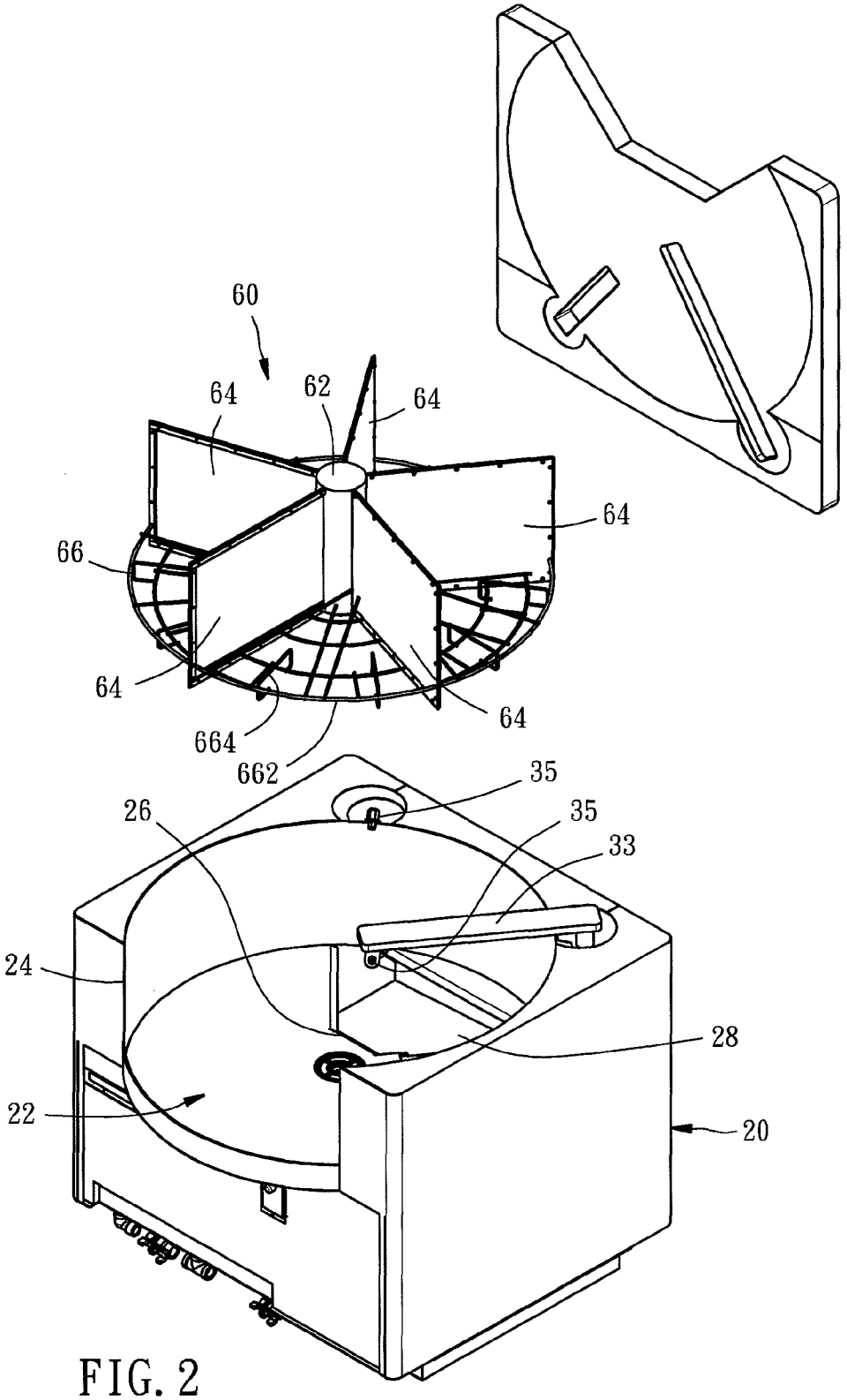
FIG. 2 is an exploded view of the rotary dinnerware washing apparatus in accordance with the present invention.
Figure 3:
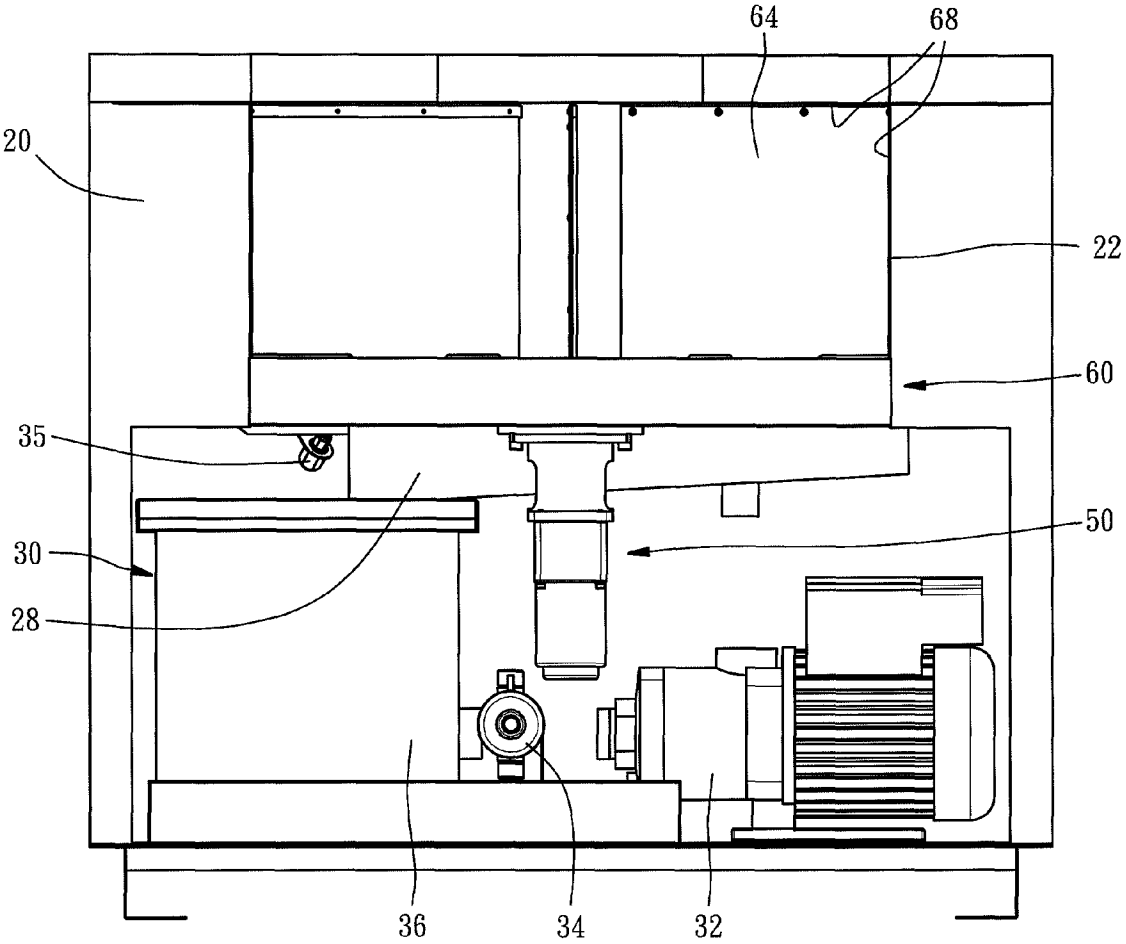
FIG. 3 is a sectional side view of the present invention, illustrating the internal structure of the rotary dinnerware washing apparatus.

As shown in FIGS. 1~3, a rotary dinnerware washing apparatus 10 in accordance with the present invention is shown comprising a housing 20, a washing mechanism 30, a rotating mechanism 40.

The housing 20 defines a washing chamber 22 in an upper part thereof, an access hole 24 in communication with the washing chamber 22 for enabling dinnerware to be put into or taken out of the washing chamber 22, a guide port 26 located on the bottom wall of the washing chamber 22, and a guide plate 28 arranged at the bottom side of the washing chamber 22. As illustrated in FIGS. 2 and 3, the guide plate 28 extends obliquely downwardly from the guide port 26.

Figure 4:
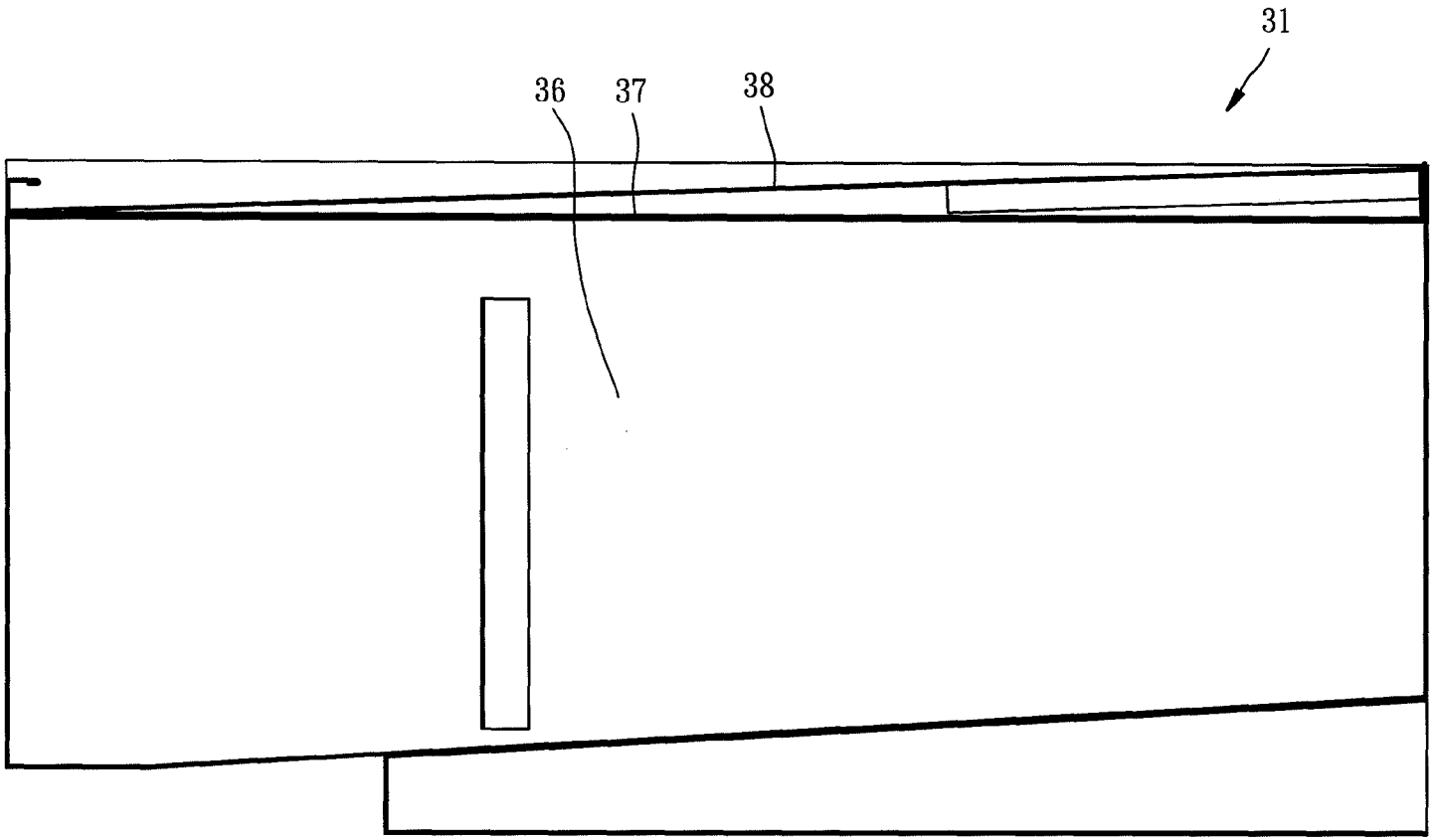
FIG. 4 is a sectional side view of the recycled water tank of the rotary dinnerware washing apparatus in accordance with the present invention.

The washing mechanism 30 comprises a recycled water tank 31, a pump 32, two spray bars 33, a water heater 34 and two hot water nozzles 35, as shown in FIGS. 2 and 3. The recycled water tank 31 is mounted in the lower half of the housing 20 below the guide plate 28, comprising a tank body 36, a fine wire gauze filter 37 and a coarse wire gauze filter 38, as shown in FIGS. 3 and 4. The fine wire gauze filter 37 is horizontally arranged at the top side of the tank body 36. The coarse wire gauze filter 38 is obliquely arranged at the top side of the fine wire gauze filter 37. The mesh size of the coarse wire gauze filter 38 is greater than that of the fine wire gauze filter 37. The pump 32 is connected with the tank body 36 of the recycled water tank 31, and adapted for pumping recycled water out of the tank body 36 into the two spray bars 33. The two spray bars 33 are respectively arranged at the top and bottom sides of the washing chamber 22, and connected to the pump 32, as shown in FIG. 2, and adapted for spraying compressed water to remove food debris and oil stains from dinnerware. The water heater 34 is mounted in the lower half of the housing 20, and adapted for heating input water to above 85° C. for output. The two hot water nozzles 35 are connected to the water heater 34 and respectively arranged at the top and bottom sides of the washing chamber 22, and respectively kept apart from the spray bars 33 at a distance for spraying hot clean water over the inside of the washing chamber 22 to remove residual recycled water from dinnerware.

Figure 5:
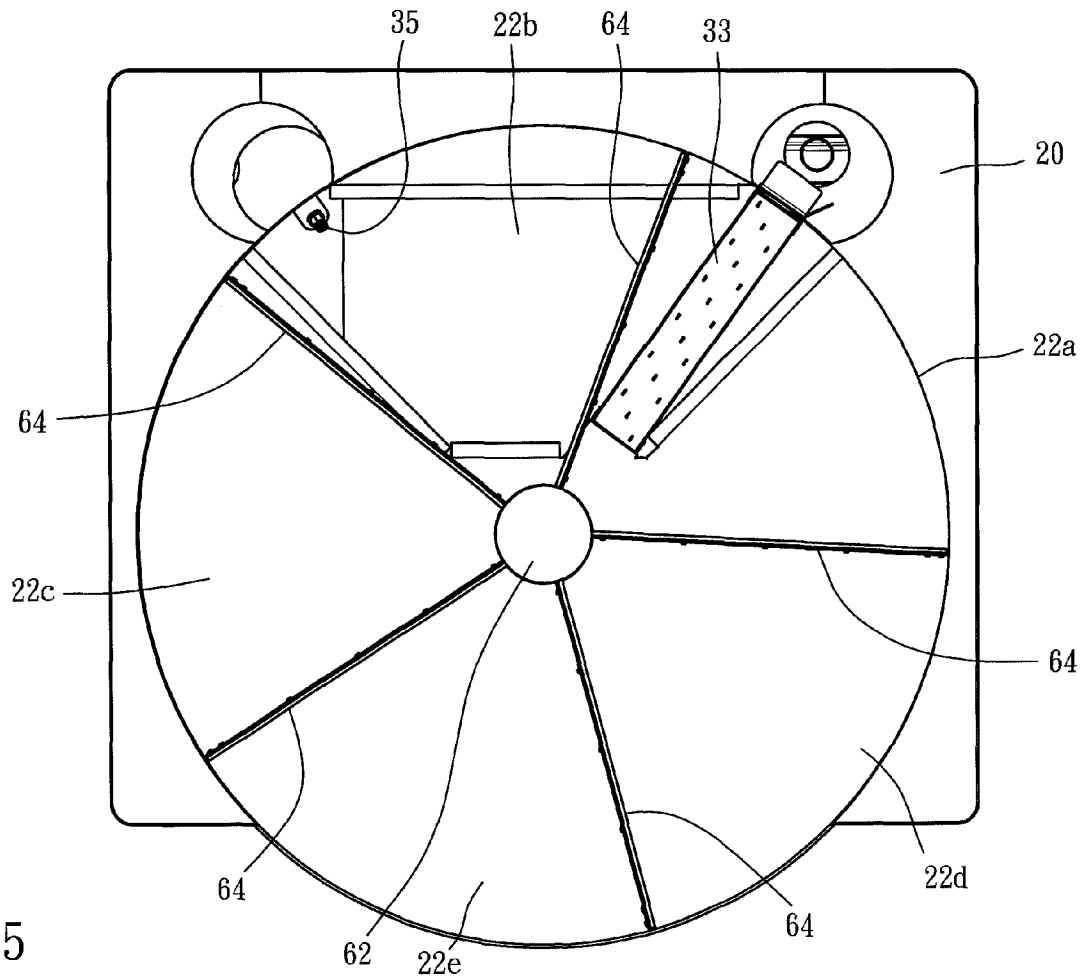
FIG. 5 is a schematic top plain view of the present invention, illustrating the relationship between the partitions of the rotating rack and the washing chamber of the housing.
Figure 6:
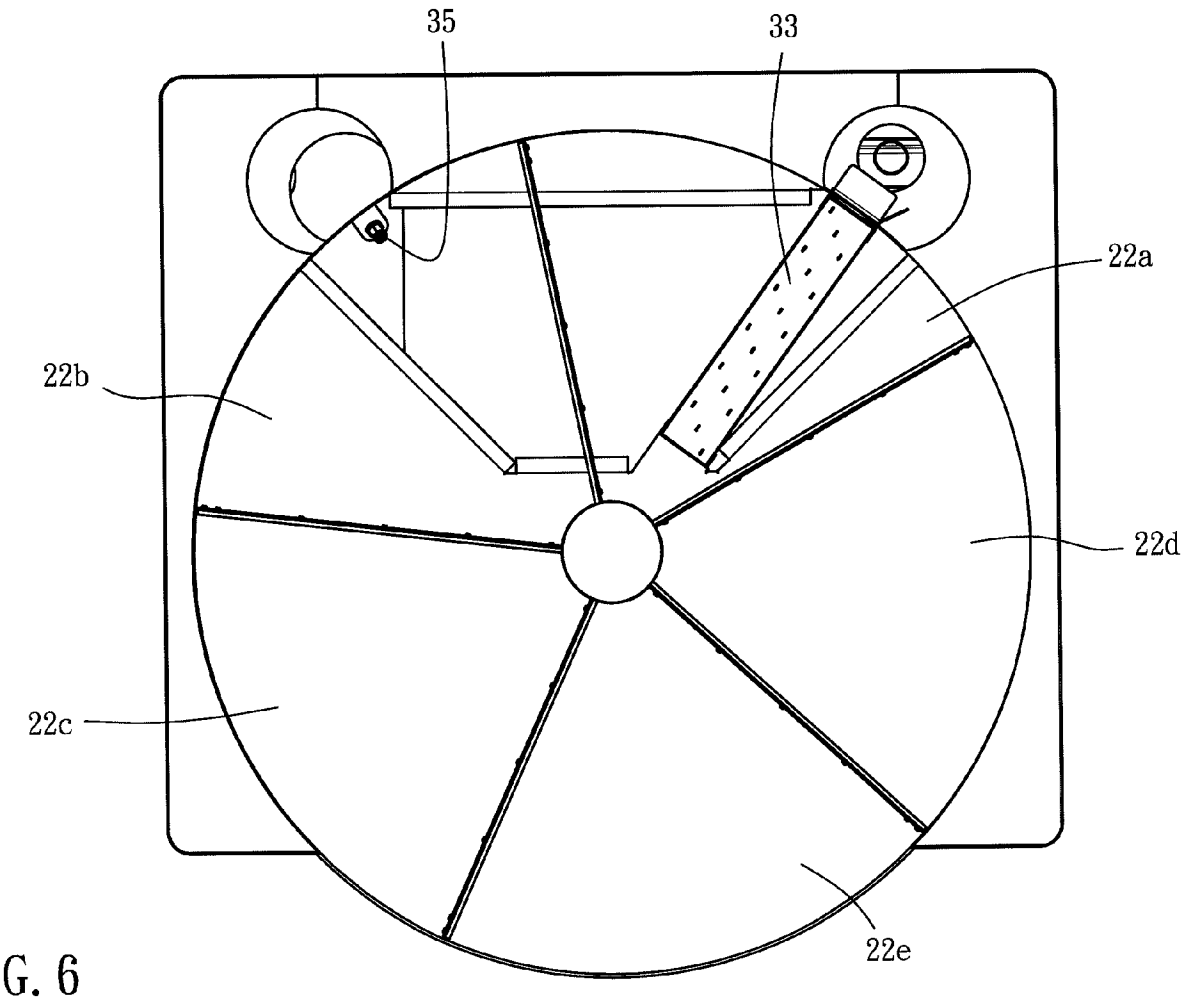
FIG. 6 corresponds to FIG. 5, illustrating the rotating rack rotated to another angular position.
Figure 7:
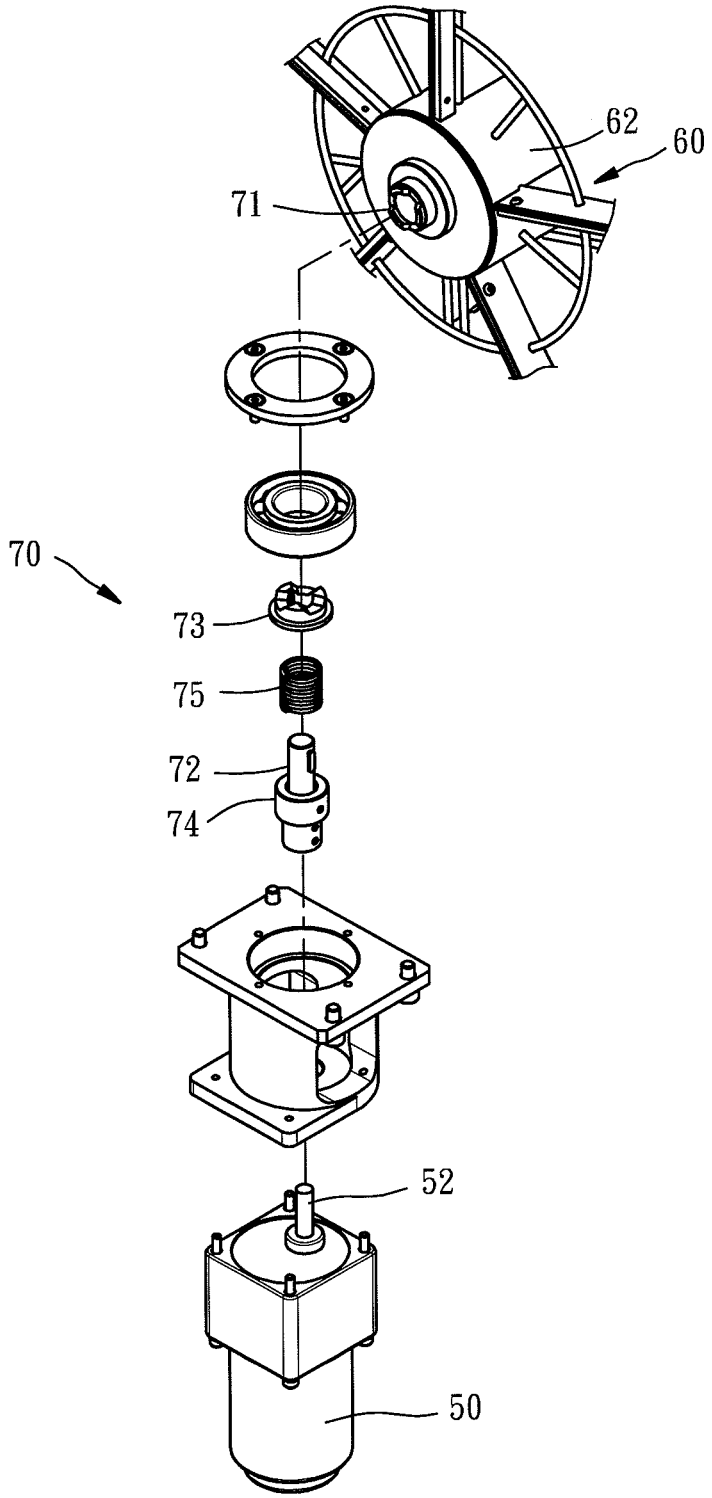
FIG. 7 is an exploded view of the clutch of the rotating mechanism of the rotary dinnerware washing apparatus in accordance with the present invention.

The rotating mechanism 40 comprises a power drive 50, a rotating rack 60, and a clutch 70. The power drive 50 is mounted in the housing 20 right below the washing chamber 22, as shown in FIG. 3. The rotating rack 60 comprises a spindle 62, 5 partitions 64 and a dish rack 66. The spindle 62 is aimed at the output shaft 52 of the power drive 50, as shown in FIG. 7. The partitions 64 extend radially from the periphery of the spindle 62 toward the peripheral wall of the washing chamber 22, dividing the washing chamber 22 into two cleaning zones 22*a*;22*b*, two buffer zones 22*c*;22*d* and a dinnerware access zone 22*e*, wherein the buffer zones 22*c*;22*d* are respectively disposed at two opposite lateral sides of the cleaning zones 22*a*;22*b*; the dinnerware access zone 22*e* is disposed between the buffer zones 22*c*;22*d*, as shown in FIG. 5. The distal end edge of each partition 64 is covered with a water seal strip 68 and kept in contact with the peripheral wall of the washing chamber 22, as shown in FIG. 3, so that cleaning zones 22*a*;22*b* and the buffer zones 22*c*;22*d* are enclosed. It is to be understood that the number of the partition 64 can be adjusted to fit different requirements. However, the number of partition 64 must be at least 2.

Figure 8:
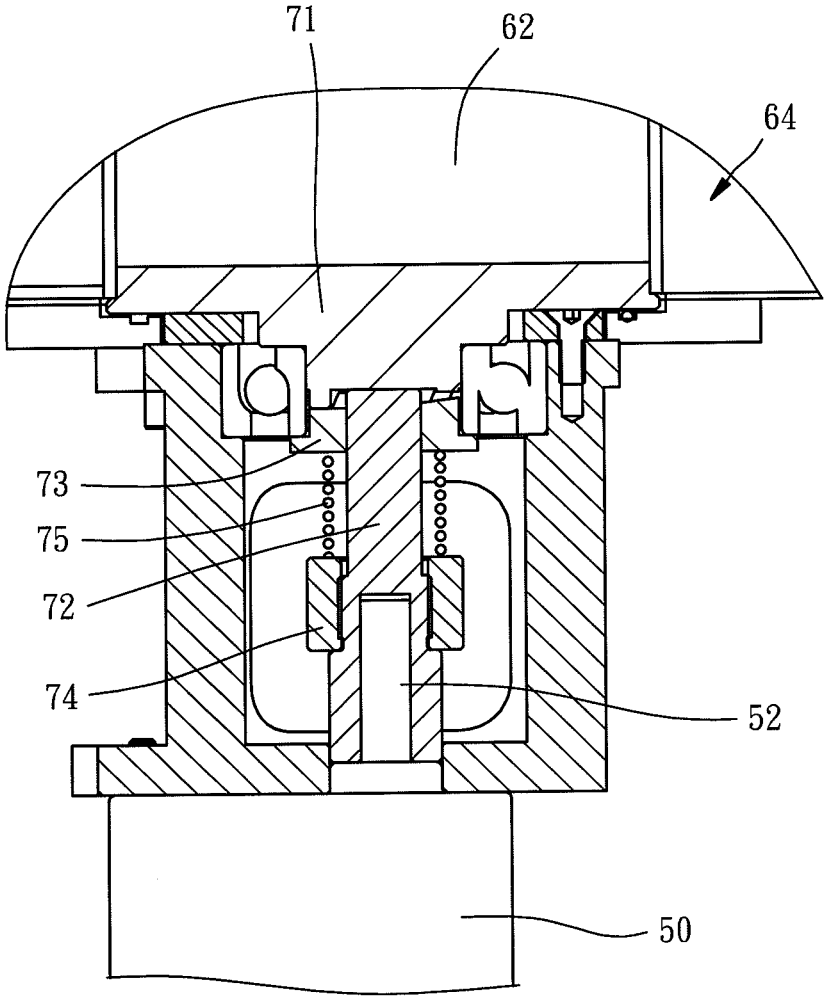
FIG. 8 is a sectional view of a part of the present invention, illustrating the first tooth block and second tooth block of the clutch meshed together.
Figure 9:
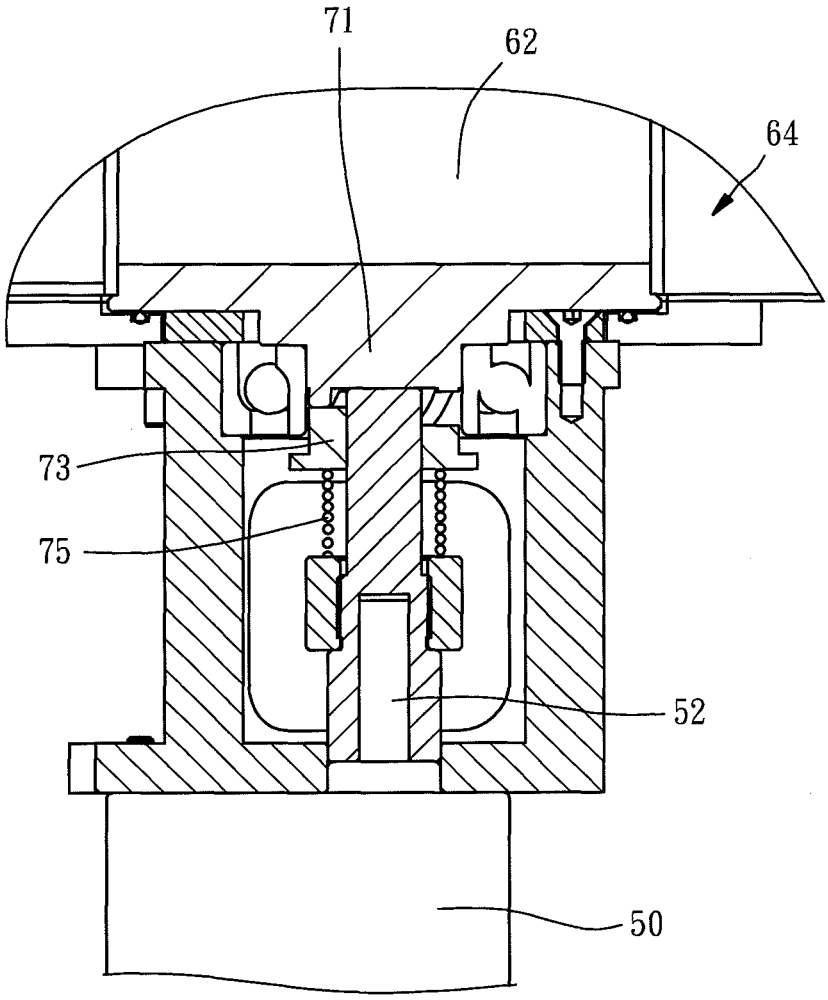
FIG. 9 corresponds to FIG. 8, illustrating the first tooth block disengaged from the second tooth block.

The dish rack 66 is attached to the partitions 64 at the bottom side to carry dinnerware and to reinforce the structural strength of the rotating rack 60. Further, the dish rack 66 comprises a plurality of a plurality of steel wire rings 662 concentrically arranged together, and a plurality of supports 664 equiangularly and radially fastened to the steel wire rings 662 for supporting dinnerware on the steel wire rings 662. The clutch 70 is set between the output shaft 52 of the power drive 50 and the spindle 62 of the rotating rack 60, comprising a first tooth block 71, a transmission shaft 72, a second tooth block 73, a sleeve 74 and a spring member 75, as shown in FIG. 7. The first tooth block 71 is fixedly mounted on the bottom end of the spindle 62. The transmission shaft 72 is coaxially coupled to the output shaft 52 of the power drive 50. The second tooth block 73 is coupled to the top end of the transmission shaft 72 opposite to the power drive 50, and detachably engaged with the first tooth block 71. The sleeve 74 is sleeved onto the bottom end of the transmission shaft 72 and affixed thereto. The spring member 75 is set between the second tooth block 73 and the sleeve 74 to impart a pressure to the second tooth block 73 toward the first tooth block 71, forcing the second tooth block 73 into engagement with the first tooth block 71. Thus, when the first tooth block 71 and the second tooth block 73 are engaged together, as shown in FIG. 8, the rotating rack 60 can be synchronously rotated by the power drive 50. When the first tooth block 71 and the second tooth block 73 are disengaged from each other, as shown in FIG. 9, the output shaft 52 of the power drive 50 will run idle without rotating the rotating rack 60.

After understanding of the structural details of the rotary dinnerware washing apparatus 10, the operation and features of the rotary dinnerware washing apparatus 10 will now be described hereinafter.

Referring to FIG. 2 and FIGS. 5~7, the dinnerware to be washed is inserted through the access hole 24 of the housing 20 into the dinnerware access zone 22*e* in the washing chamber 22 and placed on the dish rack 66 of the rotating rack 60. Thereafter, the rotating rack 60 is rotated in the washing chamber 22 by the power drive 50 subject to engagement between the first tooth block 71 and the second tooth block 73. When the rotating rack 60 is rotated to the position corresponding to the spray bars 33 of the washing mechanism 30, i.e., through the buffer zone 22*d* to the cleaning zone 22*a*, food debris is removed from the dinnerware by the recycled water sprayed by the spray bars 33. Thereafter, the rotating rack 60 is rotated to the position between the two hot water nozzles 35, i.e., the cleaning zone 22*b*, and then cleaned by hot clean water from the hot water nozzles 35. Thus, one cleaning cycle is finished. Thereafter, the rotating rack 60 is rotated through the buffer zone 22*c* to the dinnerware access zone 22*e*. At this time, the user can take the cleaned dinnerware out of the access hole 24 of the housing 20, or run another cleaning cycle. When washing dinnerware, sprayed recycled water from hot water from the spray bars 33 and hot water from the hot water nozzles 35 will be blocked by the partitions 64 of the rotating rack 60 in the washing zones 22*a*;22*b*, keeping the cleaning zones 22*a*;22*b* in an enclosed and hot condition. Thus, every piece of dinnerware can be well cleaned, thermal energy and hot water will not leak out of the cleaning zones 22*a*;22*b*, and the surroundings of the rotary dinnerware washing apparatus 10 can be kept dry and clean, maintaining a comfortable working environment.

Further, removed food debris and waste water will be guided by the guide plate 28 to the recycled water tank 31. As stated above, the coarse wire gauze filter 38 is obliquely arranged at the top side of the fine wire gauze filter 37, as shown in FIGS. 3 and 4, and the mesh size of the coarse wire gauze filter 38 is greater than that of the fine wire gauze filter 37, different pieces of food debris will be retained at the coarse wire gauze filter 38 and the fine wire gauze filter 37 for further recycling or treatment. Further, waste water will flows through the coarse wire gauze filter 38 and the fine wire gauze filter 37 to the inside of the tank body 36 and further pumped by the pump 32 for application, saving water and energy consumption and providing an environmentally friendly atmosphere.

If the rotation of the rotating rack 60 is slowed down or stopped due to blocking of an external object during the operation of the rotary dinnerware washing apparatus 10, the output shaft 52 of the power drive 50 keeps providing a torque to the rotating rack 60, and the spindle 62 of the rotating rack 60 cannot be synchronously rotated with the output shaft 52. At this time, the second tooth block 72 of the clutch 70 will be disengaged from the first tooth block 71, as shown in FIG. 9, enabling the output shaft 52 of the power drive 50 to run idle and avoiding power drive damage or accidental injury.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A rotary dinnerware washing apparatus, comprising:

a housing defining therein a washing chamber with peripheral walls;

a washing mechanism mounted in said washing chamber of said housing;

a rotating mechanism rotatably mounted in said washing chamber of said housing, said rotating mechanism comprising a plurality of partitions radially suspending in said washing chamber, each partition having an upper surface, a side surface and a lower surface, at least the upper surface and the side surface being entirely covered by a water seal strip such that the water seal strip on the upper surface and the water seal strip on the side surface respectively continuously kept in contact with the peripheral walls of said washing chamber, thereby dividing said washing chamber into at least one cleaning zone, two buffer zones and one dinnerware access zone, said two buffer zones being respectively disposed at two opposite lateral sides relative to said cleaning zone, said dinnerware access zone being disposed between said two buffer zones; and a power drive, a clutch set between said power drive and said rotating mechanism, said clutch comprising a transmission shaft, a first tooth block, a second tooth block, a sleeve and a spring member, said transmission shaft being coaxially connected to an output shaft of said power drive, said first tooth block being fixedly mounted at a bottom end of a spindle of said rotating mechanism, said second tooth block being coupled to and movable along a top end of said transmission shaft and detachably engageable with said first tooth block, said sleeve being fastened to a bottom end of said transmission shaft, said spring member being set between said second tooth block and said sleeve and adapted to force said second tooth block into engagement with said first tooth block, the clutch being disengageable during rotation if the rotating mechanism stops while the output shaft of the power drive continues to apply torque.

2. The rotary dinnerware washing apparatus as claimed in claim 1, wherein said rotating mechanism further comprises a dish rack fastened to a bottom side of each of said partitions.

3. The rotary dinnerware washing apparatus as claimed in claim 1, wherein said washing mechanism comprises a recycled water tank mounted in said housing, a pump coupled to said recycled water tank and at least one spray bar mounted around said washing chamber and connected to said pump.

4. The rotary dinnerware washing apparatus as claimed in claim 3, wherein said housing further comprises a guide port located on a bottom wall of said washing chamber, a guide plate extending obliquely downwardly from said guide port to said recycled water tank.

5. The rotary dinnerware washing apparatus as claimed in claim 4, wherein said recycled water tank comprises a tank body, a fine wire gauze filter and a coarse wire gauze filter, said fine wire gauze filter being horizontally arranged at a top side of said tank body, said coarse wire gauze filter being obliquely arranged at a top side of said fine wire gauze filter, the mesh size of said coarse wire gauze filter being greater than the mesh size of said fine wire gauze filter.

6. The rotary dinnerware washing apparatus as claimed in claim 3, wherein said washing mechanism further comprises at least one hot water nozzle mounted around said washing chamber and spaced from said at least one spray bar.

7. The rotary dinnerware washing apparatus as claimed in claim 1, wherein said housing further comprises an access hole located on one side thereof in communication with said washing chamber.

8. The rotary dinnerware washing apparatus as claimed in claim 2, wherein said dish rack comprises a plurality of steel wire rings concentrically arranged together, and a plurality of supports equiangularly and radially fastened to said steel wire rings for supporting dinnerware on said steel wire rings.

* * * * *